US006669567B1

(12) United States Patent
Scheidt et al.

(10) Patent No.: US 6,669,567 B1
(45) Date of Patent: Dec. 30, 2003

(54) DEVICE FOR HYDRAULICALLY ADJUSTING THE ANGLE OF ROTATION OF A SHAFT RELATIVE TO A DRIVING WHEEL

(75) Inventors: Martin Scheidt, Adelsdorf (DE); Jens Schafer, Herzogenaurach (DE); Dieter Neller, Hirschaid (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/110,698

(22) PCT Filed: Oct. 14, 2000

(86) PCT No.: PCT/EP00/10128

§ 371 (c)(1),
(2), (4) Date: Aug. 5, 2002

(87) PCT Pub. No.: WO01/31174

PCT Pub. Date: May 3, 2001

(30) Foreign Application Priority Data

Oct. 26, 1999 (DE) ..... 199 51 390

(51) Int. Cl.[7] ..... F01L 1/344

(52) U.S. Cl. ..... 464/2; 123/90.17; 74/568 R; 464/160

(58) Field of Search ..... 464/1, 2, 160; 123/90.15, 90.16, 90.17, 90.31; 74/567, 568 R; 403/34, 204, 341, 344

(56) References Cited

U.S. PATENT DOCUMENTS 3,109,417 A 11/1963 Bekkala et al.
5,823,152 A 10/1998 Ushida
5,836,278 A * 11/1998 Scheidt ..... 123/90.17
6,332,439 B2 * 12/2001 Sekiya et al. ..... 123/90.17
6,367,438 B2 * 4/2002 Neller ..... 123/90.17
6,481,401 B1 * 11/2002 Schafer ..... 123/90.17

FOREIGN PATENT DOCUMENTS

| | | |
|---|---|---|
| DE | 3309928 | 9/1984 |
| DE | 3937644 | 5/1991 |
| DE | 4221892 | 1/1994 |
| DE | 19755495 | 6/1999 |
| EP | 0807747 | 11/1997 |
| EP | 0896129 | 2/1999 |

OTHER PUBLICATIONS

Patent Abstracts of Japan, vol. 1999, No. 13, Nov. 30, 1999.

* cited by examiner

*Primary Examiner*—Lynne H. Browne
*Assistant Examiner*—Kenn Thompson
(74) *Attorney, Agent, or Firm*—Muserlian, Lucas and Mercanti

(57) ABSTRACT

The invention concerns a device for the hydraulic adjustment of the angular position of a shaft (1) relative to a drive pinion (14), said device comprising a plate (2) fixed to the shaft to cooperate with the drive pinion (14) or with a component fixed to the drive pinion. The device comprises at least one ring-segment shaped section (2*a*) in the plate (2) and a means (4*a*) arranged on the drive pinion (14) or on said component to cooperate with the shaped section (2*a*) so as to divide the shaped section into two separate chambers (10, 11). The device further comprises a means for a selective hydraulic pressurization of the chambers (10, 11) for adjusting the relative angular position of the drive pinion (14) and the shaft (1).

7 Claims, 5 Drawing Sheets

DEVICE FOR HYDRAULICALLY ADJUSTING THE ANGLE OF ROTATION OF A SHAFT RELATIVE TO A DRIVING WHEEL

This application is a 371 of PCT/EP00/10128 filed Oct. 14, 2000.

FIELD OF THE INVENTION

The invention concerns a device for a hydraulic adjustment of the angular position of a shaft relative to a drive pinion, said device comprising a plate fixed to the shaft to cooperate with the drive pinion for adjusting the angular position.

BACKGROUND OF THE INVENTION

A device of the pre-cited type is known, for example, from U.S. Pat. No. 3,109,417. In this and other known devices, vanes of a vane rotor divide each cell of a cell rotor into two chambers sealed relative to each other, at least one of which chambers can be pressurized. When the engine is turned off, the pressure medium flows out of the chambers through supply or discharge ducts and leak gaps.

Another device for hydraulically adjusting the angular position of a shaft, particularly a camshaft of an internal combustion engine, relative to a drive pinion is known from DE 39 37 644 A1. This device comprises a vane rotor that is fixed to the shaft and comprises radial vanes, and a cell rotor arranged on the drive to receive the vanes in circumferentially spaced cells. This device enables a pressure-controlled, hydraulic angular adjustment of the vane rotor relative to the cell rotor out of an initial position when the operation of the engine begins. To avoid a relative movement between the vane rotor and the cell rotor in the starting phase when the supply of pressure medium to the device is insufficient, the device comprises a locking device for locking the vane rotor to the cell rotor. A drawback of this device is that it is relatively expensive due to the need of vane rotors. If these vane rotors that have a relatively complex shape are made, for example by sintering, precisely defined fabrication methods must be used, and a further drawback is that a very complex and therefore cost-intensive finishing is required.

EP 0 807 747 A1 likewise discloses a device for hydraulic angular adjustment in which a vane rotor that can rotate in a cell rotor is used. The vanes are fitted into corresponding grooves of the rotor on which they are arranged. This solution necessitates a large number of separate parts and, due to the fact that the vanes have to be fitted into the grooves, exact tolerances must be respected. Consequently, this solution is also relatively complex and expensive.

OBJECTS OF THE INVENTION

It is an object of the invention to provide a device for hydraulic angular adjustment, particularly of a camshaft relative to a crankshaft, which can be manufactured in a simpler and more economic manner than conventional devices.

This and other objects and advantages of the invention will become obvious from the following detailed description.

SUMMARY OF THE INVENTION

The invention achieves the above objects by the fact that the device comprises:

at least one ring-segment shaped section arranged in the plate, a dividing means arranged on the drive pinion for dividing the shaped section into two separate chambers sealed relative to each other, and a means for a selective hydraulic pressurization of the chambers for adjusting the relative angular position of the drive pinion and the shaft.

The invention therefore provides a very simple-to-manufacture device for the hydraulic angular adjustment of a shaft relative to a drive pinion. In contrast to conventional solutions in which the vanes of a vane rotor are radially connected to the rotor, the invention permits a substantially axial connection of segments or components that take over the function of conventional vanes. Plates arranged on the drive pinion and on the driven element that correspond in function to known vane rotors and cell rotors can now be made in a substantially simpler manner. It is to be noted that the term, "shaped section" as used in the present context particularly includes impressions, cavities, elevations, grooves and slots.

DESCRIPTION OF PREFERRED EMBODIMENTS OF THE INVENTION

In a first preferred embodiment of the device of the invention, the shaped section in the plate that is connected rotationally fast to the camshaft is configured as a pocket or cavity, and the dividing means that cooperates with the shaped section for forming the two separate chambers is configured on the drive pinion as a ring-segment shaped projection that engages the pocket, the angular extent of the projection being smaller than the angular extent of the ring-segment shaped section of the first plate. In this embodiment, both the plate that is connected rotationally fast to the camshaft as well as the drive pinion can be manufactured by very simple fabrication methods. In a simple manner, shaping techniques can be used in the case of metallic materials and injection molding methods in the case of plastics. By making the angular extent of the projection smaller than the angular extent of the shaped section, a range of adjustment within which an angular adjustment is to be effected can be defined in a simple manner.

In a further preferred embodiment of the device of the invention, the drive pinion comprises two spaced walls connected to each other preferably through end faces, the plate connected rotationally fast to the shaft is arranged between the two walls, the shaped section is configured as a slot, and the dividing means for forming the separate chambers is a component that engages the slot and is in contact with the two walls. This embodiment is likewise relatively simple to manufacture and is robust and reliable in practice.

Advantageously, the component is inserted into aligned bores of the two walls and secured against axial displacement. A particularly simple and economic measure is proposed for fixing the cylindrical component on the drive pinion in that, axial securing is effected, for example, by swaging. If the bores are circular in shape and the component inserted therein has a corresponding cylindrical configuration, said component can execute a rolling motion within the slot during a relative displacement between the shaft and the drive pinion. However, it is also conceivable to fix the component in the bores so that a sliding motion can take place.

In a further preferred embodiment of the invention, the component in contact with the two walls of the drive pinion is configured as a spacer sleeve through which the first wall of the drive pinion is force-locked to the second wall by a screw connection. In this embodiment, a component rigidly fixed to the walls of the drive pinion extends through the slot thus leading to the formation of a particularly simple and robust structure. To simplify the description, the first wall of the drive pinion will be referred to in the followings as the drive pinion, as such, and the second wall, as a cover.

Advantageously, the component engaging the slot is configured with a sealing means on its outer peripheral surface. With the help of such a sealing means, a leakage between the chambers that can occur due to component tolerances and the mounting conditions of the drive pinion on the shaft can be avoided in a simple manner. This measure proves to be particularly advantageous if the component (spacer sleeve) that extends through the slot is rigidly connected to the drive pinion.

Preferably, the sealing means is configured as a plastic sleeve made particularly of a glass fiber reinforced, high-temperature resistant plastic, that can be mounted on the component. Such a plastic sleeve can be mounted in a simple manner on the component preferably having a cylindrical shape, and guarantees an efficient sealing between the chambers.

Advantageously, the sealing means comprises a protruding lip and can be loaded by a pre-stressed torsion spring. This measure guarantees that even tolerances or unevenness on the slot walls can be compensated for by an appropriate twisting of the sealing means.

According to a further feature of the invention, the sealing means is made as a shaped part, particularly as a sleeve having sealing properties. With such shaped parts, too, a good sealing action can be obtained in a simple manner.

In a further preferred embodiment of the device of the invention, the device comprises a pin-type locking device that may be operated hydraulically or mechanically to enable a mechanical securing of the drive pinion on the plate that is fixed to the camshaft.

The invention will now be described more closely with reference to some examples of embodiment of the invention illustrated in the appended drawings.

DETAILED DESCRIPTION OF THE DRAWINGS

Figure 1:
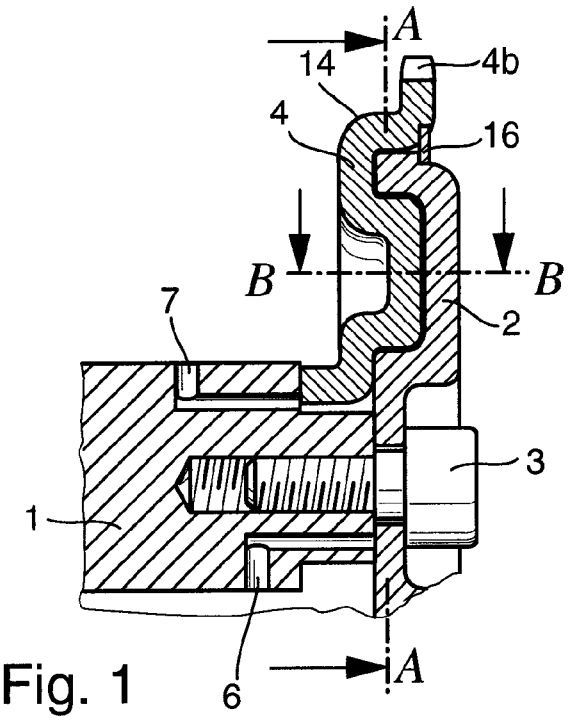
FIG. 1 is a side view in section of a first preferred embodiment of the device of the invention.

In FIG. 1 an only partly illustrated camshaft of an internal combustion engine, not shown, is identified at 1. A plate 2, commonly designated as a rotor, is frictionally connected or force-locked to the camshaft 1 by a screw 3. Further, a plate 4 serving as a drive pinion 14 is fixed for rotation on the camshaft 1. The plate 4 is configured on its outer periphery with a toothing 4*b* and serves to drive the camshaft 1 through a crankshaft-and-chain mechanism. The plates 2 and 4 are connected axially to each other through a snap ring, 16.

Figure 2:
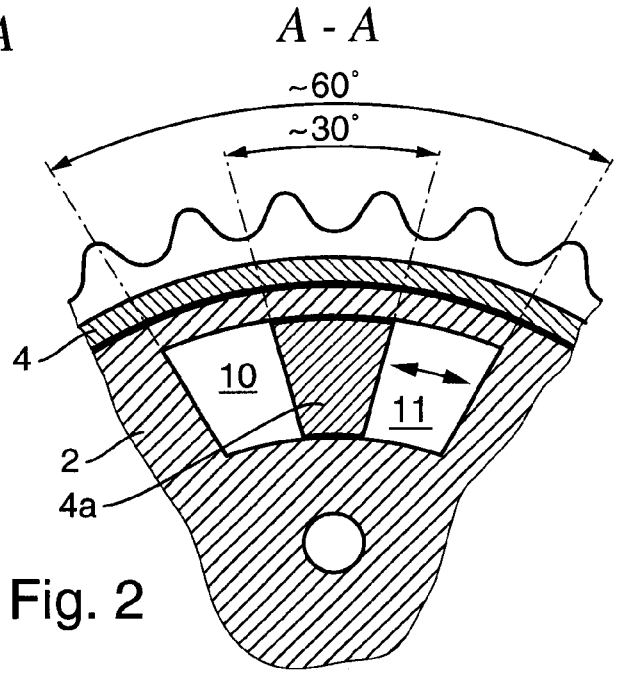
FIG. 2 shows a section along line A—A of FIG. 1.
Figure 3:
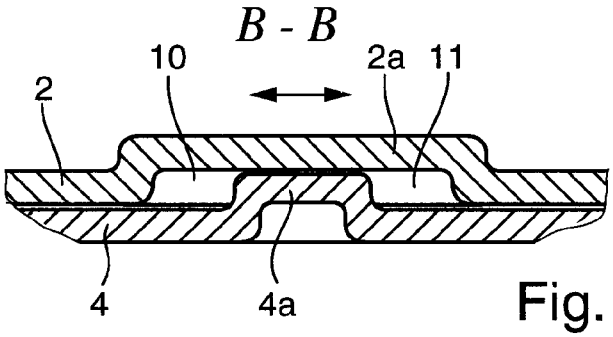
FIG. 3 shows a section along line B—B of FIG. 1.

As best seen in FIGS., 2 and 3, the plates 2 and 4 are configured with ring-segment shaped sections that cooperate with one another. In the following, the shaped section of the plate 2 is designated as a pocket 2*a*, and the shaped section of the plate 4, as a projection 4*a* that engages the pocket 2*a*. In the example of embodiment illustrated, the plate 2 comprises a plurality of integrally formed pockets 2*a* that form recesses into which the corresponding, integrally formed projections 4*a* of the plate 4 project or engage. The outer surfaces of the projections 4*a* then bear against the inner surfaces of the pockets 2*a* so that chambers 10, 11 sealed relative to each other are formed. The projections 4*a* thus serve as a dividing means for dividing the pockets 2*a* into the two chambers 10, 11. It can best be seen in FIG. 2 that the pockets 2*a* extend over a larger angle than the projections 4*a*. The chambers 10, 11 can be selectively hydraulically pressurized through oil supply ducts 6, 7 that are shown in FIG. 1. For example, a pressurization of the chamber 10 with; oil causes, in the representation of FIGS. 2 and 3, a displacement of the component 4 to the right, so that the relative angular position of the plates 2 and 4 and, thus also of the camshaft 1 and the drive pinion 14, is changed. A rotationally fixed coupling of the camshaft and the drive pinion can be achieved, for example, by an appropriate maintenance or fixing of a defined state of pressurization of the chambers 10, 11 (interruption of oil supply or discharge).

It is to be noted that the supply of oil from the oil supply ducts 6 and 7 into the chambers 10 and 11 is effected through channels, not specifically shown, that are stamped into the plates 2 and 4.

The plates 2 and 4 can be made in a simple manner by shaping or plastic forming methods (particularly injection molding). The pockets 2*a* and the projections 4*a* that cooperate with one another fulfil the function of conventional vane rotor and cell rotor mechanisms but have the advantage that the particularly expensive provision of vane rotors is not required.

Figure 4:
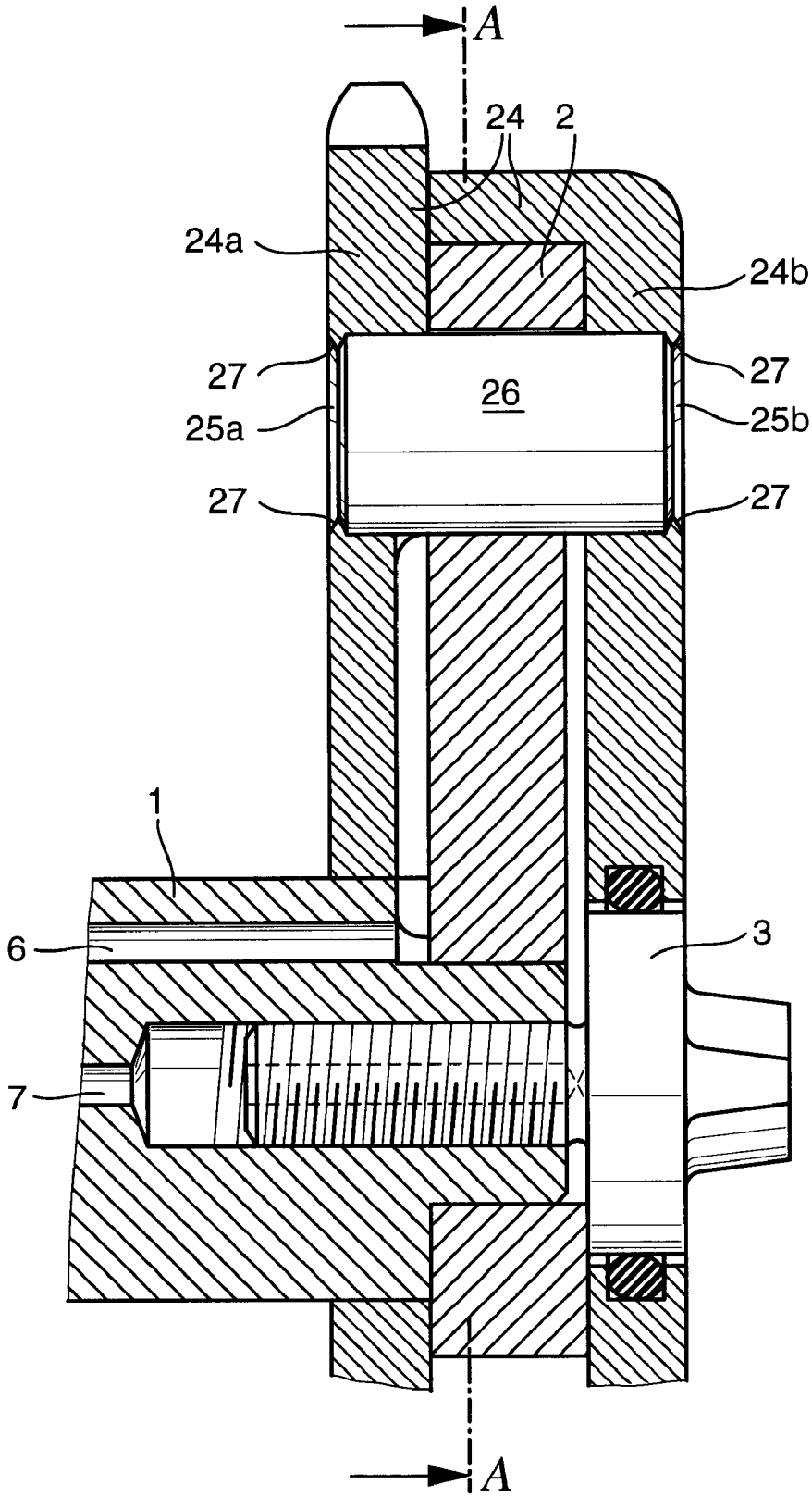
FIG. 4 is a side view in section of a second preferred embodiment of the device of the invention.
Figure 5:
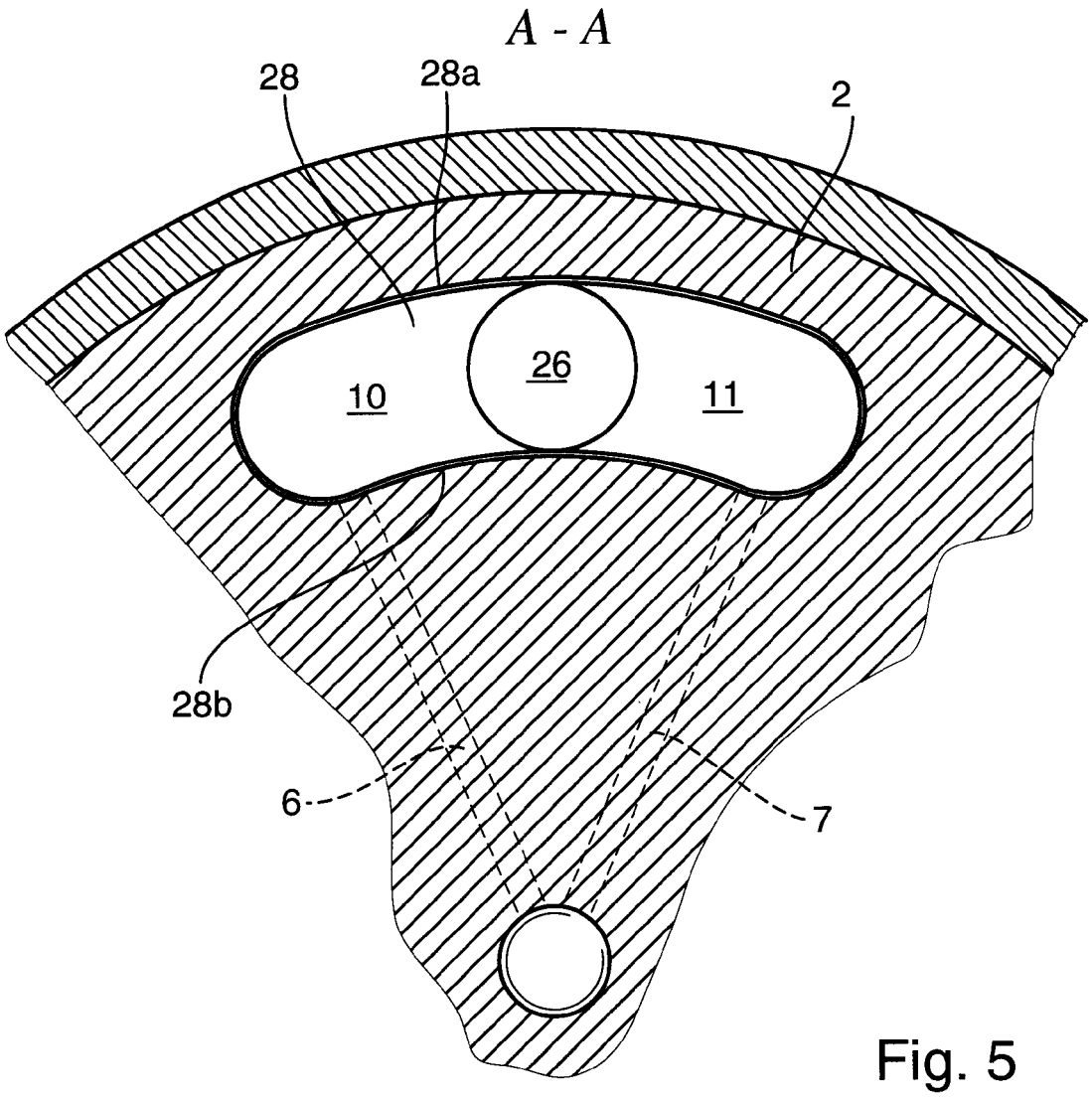
FIG. 5 is a sectional view along line A—A of FIG. 1.

A further preferred embodiment of the invention will now be described with reference to FIGS. 4 and 5. Here, too, a camshaft is identified at 1. In this embodiment, as well, a plate 2 is rotationally fixed to the camshaft 1 by a screw 3. The drive pinion identified as a whole at 24 comprises two walls 24*a* and 24*b* that are connected at end faces, for example, by welding. A rolling element 26, configured preferably as a: cylindrical roller, is inserted through aligned bores 25*a* and 25*b* arranged in the walls 24*a* and 24*b*. The rolling element 26 is secured against axial displacement by swaging (projections 27).

A slot 28 constituting a shaped section is configured in the plate 2 at the level of the bores 25*a*, 25*b*, and the rolling element 26 extends through this slot 28. The rolling element 26 bears sealingly against the upper and the lower walls 28*a*, 28*b* of the slot 28 so that relatively sealed chambers 10, 11, which can be pressurized through oil supply ducts 6, 7 with hydraulic oil, are again formed "in front of" and "behind" the rolling element 26. The relative displacement between the plate 2 and the drive pinion 24 is effected in a manner analogous to that described with reference to the first embodiment by a hydraulic pressurization of the chambers 10, 11. In the present embodiment, the rolling element 26 serves as a dividing means for forming the two chambers in the slot.

Figure 6:
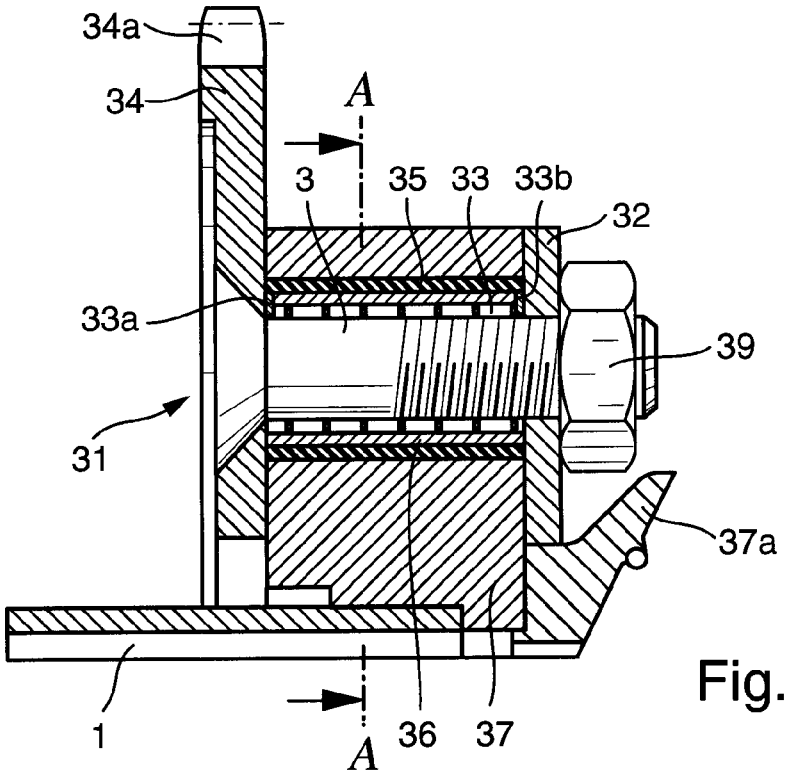
FIG. 6 is a sectional view of a further preferred embodiment of the device of the invention.
Figure 7:
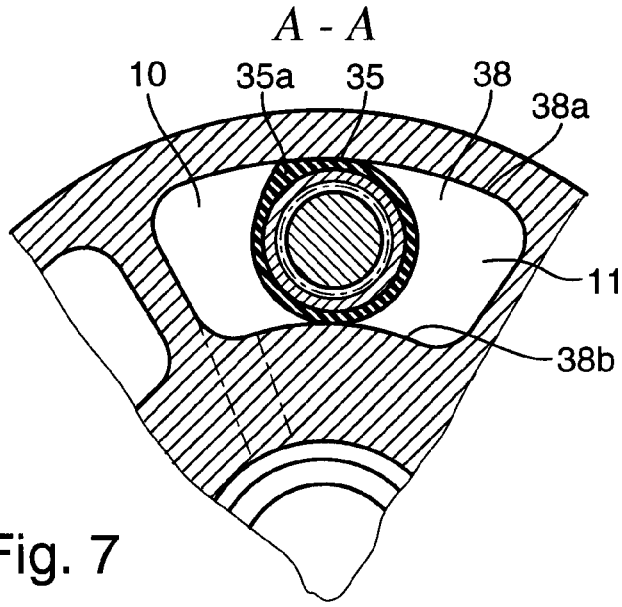
FIG. 7 is a sectional view along line A—A of FIG. 6.

FIGS. 6 and 7 show a further embodiment of the device of the invention. A first wall 32 configured as a front cover of a drive pinion 31 that can be driven by a chain of a crankshaft, not shown, is force-locked through a spacer sleeve 36 by a screw connection 39 to a second wall 34 that comprises a toothing 34*a*. All these components together form the driving sub-assembly that is connected to the crankshaft, not shown. The driven side is formed by a plate 37 that is fixed rotationally fast to the camshaft 1. Similar to the embodiment of FIGS. 4 and 5, the plate 37 is configured with a shaped section or slot 38 through which the spacer sleeve 36 extends. Two chambers 10 and 11 are defined in the slot 38 in a manner analogous to the one described with reference to FIGS. 4 and 5 . An adjustment of the relative angular position of the drive pinion 31 to the plate 37, and thus of the camshaft 1 to the crankshaft, is effected by an; appropriate hydraulic pressurization of these chambers. The most favorable manner in which the two chambers 10, 11 can be sealed relative to each other is described in the following:

Due to the fact that the driving sub-assembly 32, 34, 36 is mounted for reasons of economy preferably externally on the camshaft 1 (mounting of the first wall 32 and/or second wall 34 on the camshaft 1 or on an element fixed to the camshaft), it is necessary to provide between the spacer sleeve 36 and the walls 38*a*, 38*b* of the slot 38, a minimum clearance that corresponds to the maximum value of the theoretical external bearing clearance between the first wall 32 and/or second wall 34 on the one hand, and the camshaft 1 or a plate extension 37*a* on the other hand. An external mounting is particularly advantageous when the plate fixed to the camshaft is made of a light-weight material, for instance, aluminium. In this case, a coating, otherwise desirable for reasons of wear, can be dispensed with. Further, plates of this type can be made preferably by extrusion molding. However, this can lead to an undesired high leakage between the oil chambers 10 and 11.

For this reason, a clearance compensation element made preferably of glass fiber reinforced high-temperature resistant plastic (for example, PA46 Gf25) is formed on the spacer sleeve 36. As illustrated in FIG. 7, the clearance compensation element 35 that acts as a sealing element is configured with a sealing lip 35*a*. The optimal sealing action of the clearance compensation element 35, also during a relative motion of the spacer sleeve 36 through the slot 38 is assured by a torsion spring 33 through which the clearance compensation element 35 is pre-stressed relative to the spacer sleeve 36. The torsion spring 33 serves to apply the contact pressure of the clearance compensation element 35 to the walls 38*a* 38*b* of the slot. Advantageously, the pre-stress of the torsion spring 33 is set at a very low level so that the contact pressure is relatively low. The reason for providing this feature is that the friction of adjustment should not be unnecessarily negatively influenced, and the plate 37 and the clearance compensation element 35 should not be exposed to unnecessary wear.

The torsion spring 33 may be guided on the screw 39 or, if desired, on the inner diameter of the spacer sleeve 36. To create a biasing torque, a first end 33*a* of the torsion spring 33 is hooked into the spacer sleeve 36 and a second end 33*b* into the clearance compensation element 35. To create the recess required for hooking in the spring end 33*a*, the spacer sleeve 36 can comprise a slit. Advantageously, the clearance compensation element 35 also comprises an appropriate recess that can be made, for example, during an injection molding process.

The clearance compensation element 35 and the spacer sleeve 36 at the same time assure the axial sealing between the two chambers 10 and 11. For this purpose, their axial dimensions have to be closely matched to each other. This can be done by joining the clearance compensation element 35 and the spacer sleeve 36 to each other before they are given their final length by machining them together to the desired axial dimension.

Alternatively to the described configuration of the clearance compensation element 35 with a sealing lip 35*a*, it is also possible for the clearance compensation element to have any suitable outer contour, like for instance, a contour with eccentric bores. Further, oviform contours are also conceivable.

Figure 8:
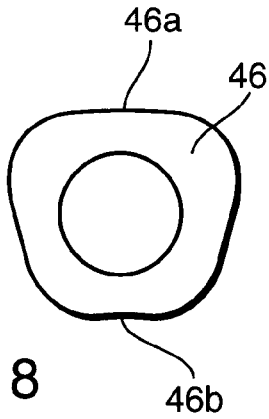
FIG. 8 is a sectional view of a preferred embodiment of a component of the invention that can be used as seal.

FIG. 8 shows a further preferred embodiment of a sleeve 46 with a sealing function that can be inserted into a ring-segment shaped slot. By way of example, it can be presumed that the sleeve 46 has to be inserted into a slot 38 as described with reference to FIG. 7. It will be seen that the upper side 46*a* and the lower side 46*b* of the sleeve 46 are configured to match the contour of the walls 38*a* and 38*b* of the slot 38. An advantageous method of fabricating such a sleeve is to start with a ring blank having exact inner and outer diameters which are then ground to the required "height". By adapting the contour of the sleeve to the contour of the slot (arc-shaped), an increase of the length of the sealing gap between the oil chambers 10 and 11 is achieved which results in a very good: sealing properties.

Figure 9:
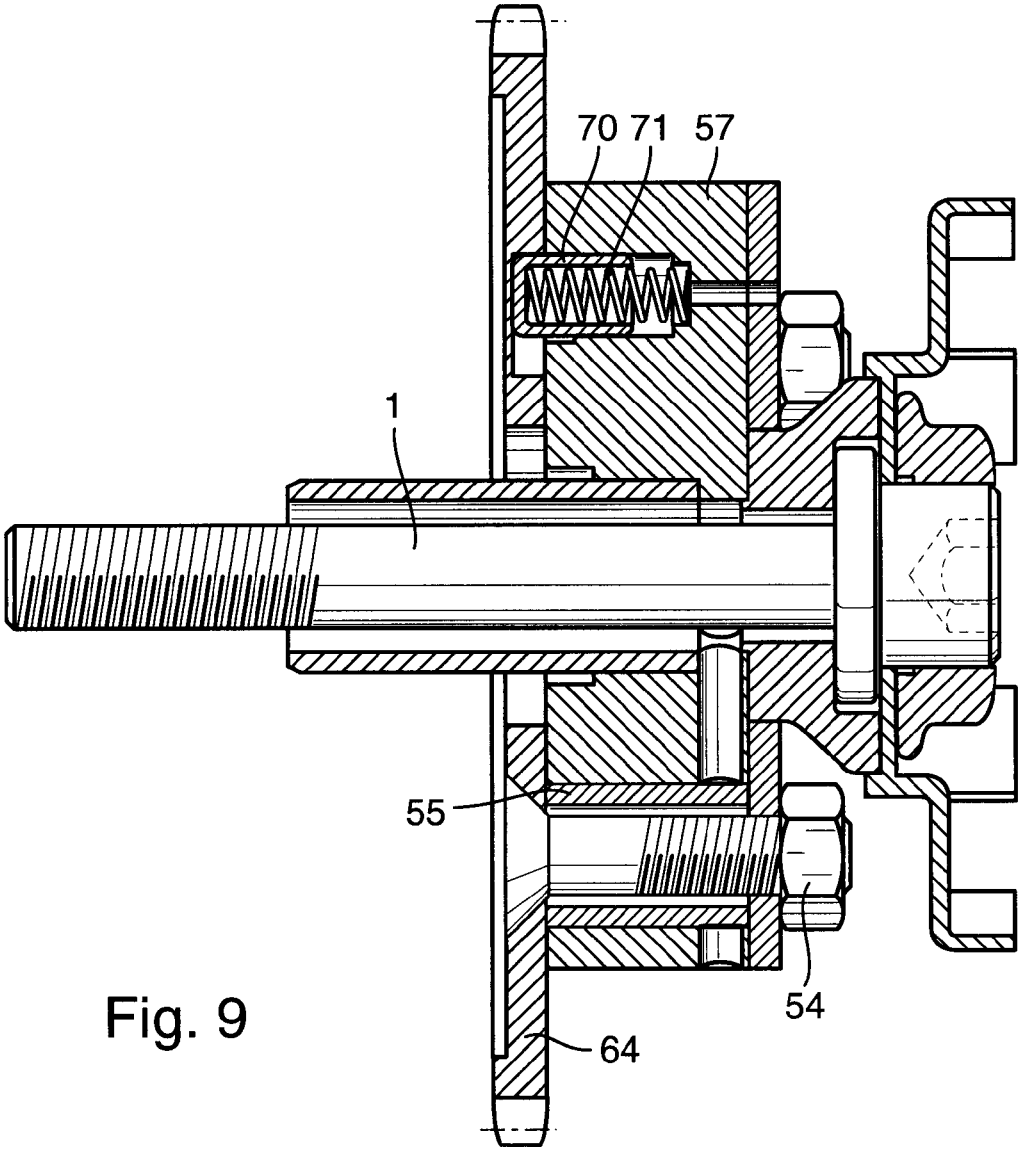
FIG. 9 is a sectional view of a further preferred embodiment of the device of the invention.

Finally, FIG. 9 shows a further preferred embodiment of the device of the invention. The device of this embodiment corresponds generally to the device illustrated in FIGS. 6 and 7. For example, it can be seen that a sleeve 55 is fixed on a drive pinion 64 by a screw connection 54. The sealing means with which the sleeve 55 can be configured is not represented in detail in this figure.

This embodiment further comprises a pin-type locking device 70 that may be actuated hydraulically or mechanically, for example by a spring, to permit a mechanical securing of the drive pinion 64 on a plate 57 that is fixed to the camshaft. This measure serves to prevent a relative rotation between the drive pinion and the plate 57 during the starting phase when the supply of hydraulic medium to the device is insufficient. When the hydraulic supply is adequate, the pin-type locking device 70, that is shown in FIG. 9 in an engaged state with the drive pinion 64, can be displaced back into a corresponding recess of the plate 57.

What is claimed is:

1. A device for a hydraulic adjustment of an angular position of a shaft relative to a drive pinion, said device comprising a plate fixed to the shaft to cooperate with the drive pinion for adjusting the angular position wherein at least one ring-segment shaped section is arranged in the plate, a dividing means is arranged on the drive pinion for dividing the shaped section into two separate chambers sealed relative to each other, a means is provided for a selective hydraulic pressurization of the chambers for adjusting the angular position of the drive pinion relative to the shaft the drive pinion comprises two spaced walls that are connected to each other, and the plate is arranged between these walls, the shaped section is configured as a slot and the dividing means is in contact with the walls while extending through the slot, the dividing means is cylindrical in shape and comprises a sealing means on an outer peripheral surface.

2. A device of claim 1, wherein the dividing means is configured as a rolling element that is inserted-into aligned bores of the walls while being secured against axial displacement.

3. A device of claim 1, wherein the dividing means is configured as a spacer sleeve through which one of the walls of the drive pinion is force-locked to the other of the walls of the drive pinion by a screw connection.

4. A device of claim 1, wherein the sealing means is configured as a plastic sleeve that is adapted to be mounted on the dividing means.

5. A device of claim 4, wherein the sealing means comprises a protruding lip and can be biased by a torsion spring.

6. A device of claim 1, wherein the sealing means is made as a shaped part.

7. A device of claim 6, wherein the shaped part is a sleeve having a sealing property.

* * * * *